United States Patent [19]

Kerviel et al.

[11] Patent Number: 4,554,031

[45] Date of Patent: Nov. 19, 1985

[54] COLD MOLDABLE EXPLOSIVE COMPOSITION

[75] Inventors: Hildebert Kerviel, Chelles; Serge Poulard, Saint-Mande, both of France

[73] Assignee: Commissariat a l'Energie Atomique, Paris, France

[21] Appl. No.: 604,937

[22] Filed: Apr. 27, 1984

[30] Foreign Application Priority Data

May 3, 1983 [FR] France ..... 83 07347

[51] Int. Cl.[4] ..... C06B 45/10

[52] U.S. Cl. ..... 149/19.3; 149/92; 149/93; 149/105

[58] Field of Search ..... 149/19.3, 92, 93, 105

[56] References Cited

U.S. PATENT DOCUMENTS 3,181,982 5/1965 Burnside et al. ..... 149/19.3
3,296,041 1/1967 Wright ..... 149/19.3
3,985,595 10/1976 Benziger ..... 149/19.3
4,120,710 10/1978 Peters et al. ..... 149/88
4,131,499 12/1978 Flanigan ..... 149/19.3

FOREIGN PATENT DOCUMENTS 1469198 1/1967 France .
2135534 12/1972 France .

*Primary Examiner*—Edward A. Miller

[57] ABSTRACT

A cold moldable explosive composition comprises 85 to 98% by weight of at least one explosive chosen from among octogen, hexogen, pentrite, hexanitrostilbene and triaminotrinitrobenzene, 1.5 to 11% by weight of a thermoplastic binder constituted by a chlorinated and/or fluorinated elastomer, such as copolymer of trifluorochloroethylene and vinylidene fluoride and 0.5 to 4% of a fluorinated plasticizer constituted e.g. by a low molecular weight trifluorochloroethylene polymer.

3 Claims, No Drawings

COLD MOLDABLE EXPLOSIVE COMPOSITION

BACKGROUND OF THE INVENTION

The present invention relates to a cold moldable explosive composition and to its preparation process. More specifically it relates to explosive compositions containing a powerful explosive and a thermoplastic binder in the form of a cold moldable powder.

In general, explosive compositions are constituted by an explosive charge dispersed in a thermoplastic or thermosetting binder. The standard procedure for obtaining such compositions is to coat an explosive powder with the thermoplastic or thermosetting binder and to then consolidate the coated powder by compression.

When using a thermoplastic binder in the manner described in U.S. Pat. Nos. 3 173 817 and 3 400 115, it is necessary to perform the compression stage hot.

When thermosetting binders are used in the manner described in French Pat. No. 2 268 770 (Commissariat á l'Energie Atomique), No. 2 144 988 ((French State), No. 2 241 514 (Messerschmitt), No. 2 138 513 (Commissariat á l'Energie Atomique) and No. 2 225 979 (French State), in most cases it is necessary to carry out hot compression in order to obtain the desired characteristics.

Performing the compression stage hot leads to certain problems, when it is wished to bring the explosive composition into a particular form.

Thus, it is necessary in this case firstly to prepare a block by hot compression and then remachine the block obtained. Therefore, the performance of a hot compression stage is technically and economically very onerous.

However, certain explosive compositions coated with thermosetting binders can be compressed cold or extruded in the manner described in European Pat. No. 003 6481 (Delsenroth). In this case, use is made of a polyurethane-based binder and the coating operation is carried out by using an aqueous polyurethane dispersion. However, the coated explosive powder obtained in this way does not have an adequate storage stability and must therefore be rapidly moulded. Thus, thermosetting binders are not stable over a period of time, because they slowly crosslink and polymerize, which is prejudicial for the subsequent performance under satisfactory conditions of the compression stage of the binder-coated explosive powder.

SUMMARY OF THE INVENTION

The present invention relates to an explosive composition which, although containing a thermoplastic binder, has the advantage of being mouldable at ambient temperature and of being stable over a period of time.

The present invention therefore relates to an explosive composition wherein it comprises 85 to 98% by weight of at least one explosive chosen from the group including cyclotetra-methylenetetranitramine (octogen), cyclotrimethylenetrinitramine (hexogen), triaminotrinitrobenzene (TATB), pentaerythritol tetranitrate (pentrite) and hexanitrostilbene (HNS, 1.5 to 11% by weight of a thermoplastic binder constituted by a chlorinated and/or fluorinated elastomer, and 0.5 to 4% of a fluorinated plasticizer.

According to the invention, the chlorinated and/or fluorinated elastomers which can be used as thermoplastic binders are polymers and copolymers of chlorinated hydrocarbons, such as polytrifluorochloroethylene and copolymers of trifluorochloroethylene and vinylidene fluoride.

Preferably, the thermoplastic binder is a copolymer of trifluorochloroethylene and vinylidene fluoride, for example the product marketed under the trademark "Voltalef BP 5500".

According to the invention, the fluorinated plasticizers which can be used are low molecular weight polymers.

Preferably, the florinated plasticizer is a trifluorochloroethylene polymer with a molecular weight of 500 to 1000, e.g. the oil marketed under trademark "Voltalef S 10".

Advantageously, in the explosive composition according to the invention, the plasticiser:binder weight ratio is approximately 1:3 to 1:1.

According to a preferred embodiment of the invention, the explosive composition comprises 96% octogen, 3% elastomer, constituted by a copolymer of trifluorochloroethylene and vinylidene fluoride and 1% of a fluorinated polymer having a molecular weight between 500 and 1000.

As a result of the choice of the thermoplastic binder and the addition of a fluorinated plasticizer, the explosive compositions according to the invention prepared in the form of powders can contain a high explosive proportion (up to 98%), and can be brought into the desired shape by cold molding, even after a relatively long storage period, e.g. ranging up to more than 12 months.

The explosive compositions according to the invention can be prepared by conventional processes. However, according to the invention, for safety reasons preference is given to the preparation of the explosive composition on the basis of the suspension of the explosive powder in water.

Thus, the invention also relates to a process for the preparation of a cold moldable explosive powder coated with a thermoplastic binder, wherein it comprises:

(a) dissolving in an organic solvent which is immiscible in water a thermoplastic binder constituted by a chlorinated and/or fluorinated elastomer and a fluorinated plasticizer, (b) suspending in water a powder of at least one explosive chosen from the group including octogen, hexogen, triaminotrinitrobenzene, pentaerithritol tetranitrate and hexanitrostilbene, (c) heating the suspension to a temperature below 100° C., (d) pouring dropwise into the thus heated suspension the solution of the binder and plasticizer obtained in stage (a), (e) evaporating the organic solvent, (f) filtering the suspension, (g) washing and suction drying the coated explosive powder separated in this way from the suspension liquid, and (h) vacuum drying the said explosive powder.

Preferably, according to the invention, 60% of the explosive powder used as the starting product in stage (b) is a grain size between 200 and 630 μm and 30% of the explosive powder used as the starting product in stage (b) has a grain size at the most equal to 100 μm.

This in particular makes it possible to bring about a greater tamping of the explosive during the compression of the powder.

The powders obtained by the process according to the invention can then be brought into the desired form or shape by conventional pressure moulding processes at ambient temperature, preferably using a pressure of 100 to 200 MPa.

DETAILED DESCRIPTION OF THE INVENTION

Other features and advantages of the invention can be gathered from reading the following illustrative and non-limitative exemplified description.

This example illustrates the preparation of an explosive composition including octogen, an elastomer constituted by a copolymer of trifluorochloroethylene and vinylidene floride (thermoplastic binder), namely the product sold under the trade name "Voltalef 5500 BP" and a fluorinated plasticizer constituted by a trifluorochloroethylene polymer with a molecular weight of approximately 800, namely the product sold under the trade name "Voltalef S 10".

A solution of the binder and the plasticizer is firstly prepared by dissolving at ambient temperature 750 g of Voltalef BP 5500 in 10 liters of ethyl acetate and then adding to the solution 250 g of Voltalef S 10 oil.

Into a reactor are introduced 14.4 g. of octogen with a grain size of 200 to 630 μm and 9.6 kg. of octogen with a grain size of 0 to 100 μm with 100 liters of water, followed by stirring at 150 r.p.m. The reactor content is then heated to 50° C. under a reduced pressure of 0.05 MPa and the solution of the binder and the plasticizer is then poured dropwise into the reactor. The reactor temperature is then progressively increased to 90° C. to completely eliminate the organic solvent.

This is followed by cooling and filtration takes place over a 5 μm cloth filter in order to recover coated octogen. The latter is then washed accompanied by stirring at 350 r.p.m., followed by suction filtration at 1000 r.p.m. The powder obtained is then dried in a vacuum drier for 48 h at 50° C. giving a powder with an average grain size of 1 mm.

The characteristics of the powder obtained are checked by subjecting it to the conventional safety tests, consisting of determining:

the gaseous emission during a vacuum test for 70 h at a temperature of 120° C., the deflagration temperature of the coated explosive, and the shock sensitivity of the powder.

The results obtained are as follows:

gaseous emission during the vacuum test for 70 h at 120° C.: 8 ml/100 g, deflagration temperature: 271° C., and shock sensitivity $H_T-H_O/H_T=-0.30$.

The coated powder is then used for preparing by conventional molding at 20° C. using three pressure cycles of 150 MPa for 15 min, or by isostatic moulding carried out under the same conditions (three cycles at 20° C. under 150 MPa for 15 min), a diameter 40 mm and height 50 mm billet.

In the first case, the density of the member obtained is 1.850, whereas it is 1.849 in the case of isostatic compression molding. Thus, very good results are obtained in both cases because the theoretical density is 1.899.

Tests are also carried out to determine the detonation properties of the thus obtained explosive and the results are density 1.849 g/cm$^3$ and detonation velocity 8830 m/s.

Thus, the explosive according to the invention has good detonation characteristics.

We claim:

1. A cold-mouldable explosive composition comprising from about 85% to 98% by weight of at least one explosive selected from the group consisting of cyclotetramethylenetetranitramine (octogen), cyclotrimethylenetrinitramine (hexogen), triaminotrinitrobenzene (TATB), pentaerythritoltetranitrate (pentrite) and hexanitrostilbene (HNS), from about 1.5 to 11% by weight of a thermoplastic elastomeric binder comprising a copolymer of trifluorochloroethylene and vinylidene fluoride, and from about 0.5 to 4% of a fluorinated plasticizer comprising a trifluorochloroethylene polymer having a molecular weight of from about 500 to 1000.

2. Composition according to claim 1, wherein the plasticiser:binder weight ratio is approximately 1:3 to 1:1.

3. An explosive composition according to claim 1, wherein it comprises 96% octogen, 3% elastomer constituted by a copolymer of trifluorochloroethylene and vinylidene chloride, and 1% of fluorinated polymer having a molecular weight of 500 to 1000.

* * * * *